United States Patent [19]

Oscarsson

[11] Patent Number: 4,799,865

[45] Date of Patent: Jan. 24, 1989

[54] INTERMITTENT SERVICE SCREW COMPRESSOR

[75] Inventor: Johnny Oscarsson, Gustavsberg, Sweden

[73] Assignee: Svenska Rotor Maskiner AB, Stockholm, Sweden

[21] Appl. No.: 90,799

[22] PCT Filed: Dec. 8, 1986

[86] PCT No.: PCT/SE86/00557

§ 371 Date: Aug. 3, 1987

§ 102(e) Date: Aug. 3, 1987

[87] PCT Pub. No.: WO87/03651

PCT Pub. Date: Jun. 18, 1987

[30] Foreign Application Priority Data

Dec. 10, 1985 [SE] Sweden ..... 8505821

[51] Int. Cl.[4] ..... F04B 49/02; F04C 18/16; F04C 29/00

[52] U.S. Cl. ..... 417/283; 417/440; 418/84; 418/97; 418/201

[58] Field of Search ..... 417/310, 283, 440; 418/84, 87, 97, 201, 202, 203

[56] References Cited

U.S. PATENT DOCUMENTS

| | | | |
|---|---|---|---|
| 2,383,979 | 9/1945 | Lysholm | 60/601 |
| 2,519,913 | 8/1950 | Lysholm | 418/201 |
| 3,108,739 | 10/1963 | Nilsson et al. | 418/201 |
| 3,905,729 | 9/1975 | Bauer | 418/97 |
| 4,073,605 | 2/1978 | Wakeman et al. | 417/283 |
| 4,242,067 | 12/1980 | Segerstrom | 418/203 |
| 4,412,788 | 11/1983 | Shaw et al. | 417/310 |
| 4,457,681 | 7/1984 | Garland | 418/201 |

*Primary Examiner*—Carlton R. Croyle
*Assistant Examiner*—Leonard P. Walnoha
*Attorney, Agent, or Firm*—Frishauf, Holtz, Goodman & Woodward

[57] ABSTRACT

A screw compressor for intermittent operation, preferably for supplying a pneumatic brake system of an automotive vehicle with compressed air, comprises, in the high pressure end wall (4) of the compressor, a wall plate (14) which seals against the casing wall (2) of the compressor and which can be withdrawn axially of the compressor out of sealing engagement with the casing wall and into a space (16) which is provided in the high pressure end wall, the space (16) communicating with the compressor inlet (12), to thereby fully unload the compressor.

4 Claims, 1 Drawing Sheet

INTERMITTENT SERVICE SCREW COMPRESSOR

BACKGROUND OF THE INVENTION

The present invention relates to a screw compressor for intermittent operation which comprises a compressor housing having a casing wall which encloses at least two compression chamber which partially overlap one another in a radial direction and each of which accommodates a screw rotor and is closed at the ends by a high-pressure end wall and a low-pressure end wall.

A compressor of this kind can be used conveniently for maintaining the level of pressure in the pneumatic brake system of an automotive vehicle. The compressor is normally activated, or engaged, via a coupling when the engine of the vehicle is started, and is de-activated or disengaged through the coupling subsequent to reaching the intended pressure in the brake system. The compressor is re-engaged when the need arises, i.e. when the pressure has fallen to a given level. The coupling required herefor is both relatively expensive and bulky, and can be omitted in those instances when the compressor is driven by a separate motor, such as an electric motor, capable of being started and stopped in a corresponding manner. This latter solution is not an ideal solution, however, and consequently there is a need for improvement in this regard.

The object of the present invention is to provide a compressor which is particularly suited to intermittent operation and which is not encumbered with the aforesaid drawbacks.

This object is achieved with a compressor constructed in accordance with the invention and having the characterizing features set forth in the claims.

By enabling the whole of the wall plate of the high-pressure end wall located adjacent the rotor ends to be displaced axially through a short distance and therewith open, or unseal, the compression chambers, the air flowing through the compressor is recycled to the inlet side thereof practically without loss, i.e. the compressor is driven in a fully unloaded or inactive state until it needs to be re-engaged. Re-engagement of the compressor is effected by returning the wall plate of said high-pressure end wall to its chamber sealing position, this resetting of the wall plate preferably being achieved in a controlled manner, so as to initiate production of compressed air smoothly and evenly. The wall plate can be operated readily by means of an auxiliary piston device arranged in a cylinder chamber in the high-pressure end wall and connected to said wall plate. This arrangement solely requires a pressure fluid connection, and thus obviates the need for mechanical operating devices with associated lead-through bushings in the high-pressure end wall plate.

If the rotor bearings are positioned solely at the low-pressure end of the compressor, the ends of the rotors adjacent the high-pressure end thereof may be completely flat, thereby enabling the wall plate to be imperforate and also totally flat.

Since the compressor of this kind normally incorporates an oil injection facility, there is provided in accordance with one advantageous embodiment of the invention a valve arrangement which is contructed to curtail the inflow of oil, or alternatively to cut-off the oil supply completely, when the wall plate occupies its axially withdrawn or retracted position, corresponding to the inactive state of the compressor, since with the wall plate in this position it is not necessary to cool and seal the compression chambers. Neither is there any real need for lubrication when the compressor is in its inactive state.

BRIEF DESCRIPTION OF THE DRAWINGS

The invention will now be described in more detail with reference to an exemplifying embodiment thereof illustrated in the accompanying schematic drawings, in which.

DETAILED DESCRIPTION

Figure 1:
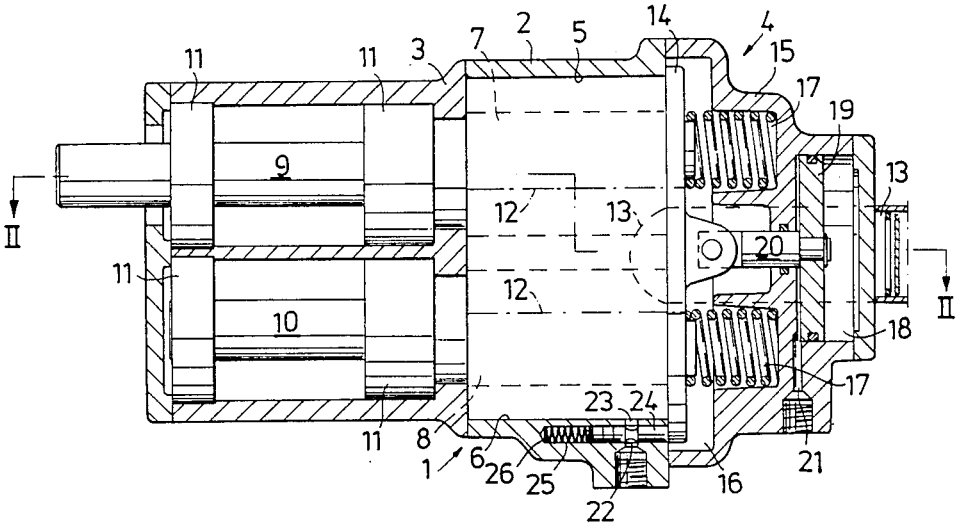
FIG. 1 is a longitudinal sectioned view of a compressor constructed in accordance with the invention.

The illustrative compressor of this embodiment has a housing 1 which comprises a casing wall 2, a low-pressure end wall 3, and a high-pressure end wall 4. The casing wall 2 encloses two radially overlapping compression chambers 5, 6, each of which accommodates a respective rotor 7 and 8, said rotors having provided thereon mutually engaging helical lands and grooves. In the illustrative embodiment the rotors 7, 8 have shafts 9, 10 which are of large diameter and which are journalled in bearings 11 located in an axial extension of the low-pressure end wall 3.

The illustrated compressor also incorporates an inlet channel, indicated in FIG. 1 with the chain line 12, located in the upper part (not shown) of the casing wall 2, and an outlet channel which is located in the lower part of the casing wall 2 and the high-pressure end wall 4, and which is indicated by the chain line 13 in FIG. 1.

The high-pressure end wall comprises two parts, namely a first part in the form of a flat, imperforate end wall plate 14 which in the active compression state of the compressor lies sealingly against a planar end-surface of the casing wall 2 and also against the planar end surfaces of the rotors 7, 8, and a second part in the form of a cap-like device 15 which is firmly attached to a flanged portion of the end-surface of said casing wall 2.

The cap-like device 15 and the wall plate 14 present between mutually opposing surfaces thereof a space 16 into which the wall plate 14 can be withdrawn in the axial direction of the compressor, against the action of two springs 17. Movement of the wall plate 14 is effected by means of a piston device 19 which is connected to the wall plate through a rod 20 and which is movable arranged in a cylinder chamber 18 incorporated in the cap-like device 15. The wall plate 14 is withdrawn, or retracted, from the position shown in FIG. 1, by supplying pressure fluid to the chamber 18, through a channel 21.

Figure 2:
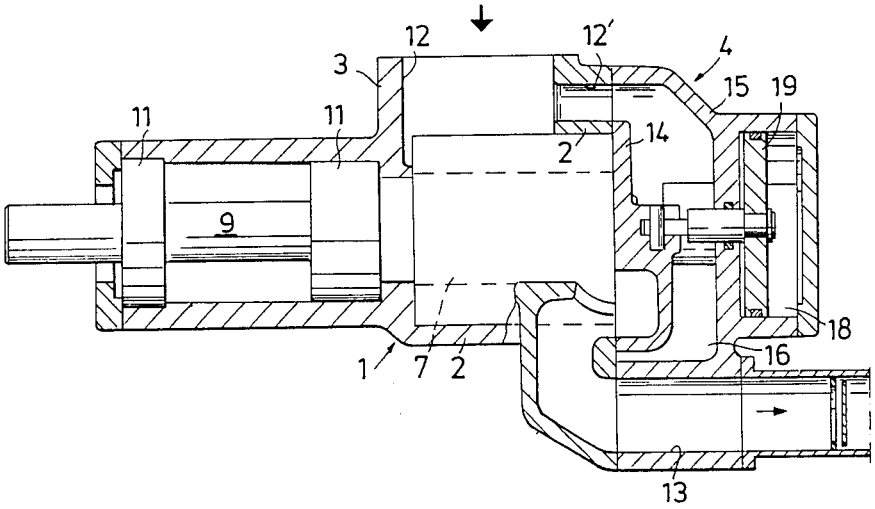
FIG. 2 is a sectional view taken on the line II—II in FIG. 1.

When the plate is moved away from its illustrative position, the space 16 and the high-pressure end of the compression chambers 5, 6 are placed in communication with the compressor inlet 12, via a channel 12' (FIG. 2), so that the air flowing through the rotor grooves is recycled to the inlet 12, i.e. the compressor is inactive and has no load thereon.

The illustrative compressor is of the kind in which oil is injected into the compression chambers, for the purpose of cooling, lubricating, and sealing the compressor. Accordingly, an oil supply channel 22 and a plurality of oil injection ports 23 are provided in the casing wall 2.

Since there is no need to inject oil into the compression when it is inactive, i.e. without load, there is provided in the casing wall a bore 25 which intersects the oil supply channel 22 and which accommodates a valve body 24 operative in interrupting the flow of oil, either fully or partially, when the compressor is inactive. In the illustrated loaded state of the compressor, the valve body is held inserted in the bore 25 by the wall plate 14, against the action of a spring 26, so that a hole or recess provided in the valve body 24 is located in the channel 22 and permits oil to pass therethrough.

On the other hand, when no load is placed on the compressor the wall plate 14 is withdrawn slightly into the space 16, such as to enable the valve body 24 to be moved outwardly by the spring 26 and close the oil supply channel 22 fully, or almost fully. Thus, no oil, or substantially no oil, will be injected into the compressor until a load is again placed thereon.

It will be understood that the invention is not restricted to the described and illustrated embodiment and that modifications can be made within the scope of the invention defined in the following claims. For example, the rotors may be journalled at both ends thereof, although this would add the complication of needing to provide the plate wall 14 with sealed apertures for accommodating the rotor shafts.

I claim:

1. A continuously driven screw compressor adapted for intermittent compressor operation, comprising:

a compressor housing means (1) which comprises a casing wall means (2) which encloses at least two radially overlappping compression chambers (5, 6) each of which accommodates a respective helical rotor (7, 8), said helical rotors each being fixedly connected to a respective bearing shaft (9, 10);

said compressor housing means including a compressor inlet (12);

said housing means (1) having spaced apart end portions, and comprising at respective end portions thereof a high-pressure end wall means (4) at a high pressure end of the compressor, and a low-pressure end wall means (3) at a low pressure end of the compressor;

said casing wall means (2) having end surfaces at least in the vicinity of said high-pressure end wall means (4);

said high-pressure end wall means (4) including:

means defining a space (16) which is in communication with said compressor inlet (12) through a channel (12'); and a movable wall plate means (14) which, in an active compression state of the compressor, is in sealing abutment with said end surfaces of said casing wall means (2) and which, for the purpose of deactivating the compressor, is movable in the axial direction of the compressor in said space (16) in said high-pressure end wall means so as to communicate said compression chambers (5, 6) with said compressor inlet (12) through said space (16) and said channel (12');

auxiliary drive means (20) coupled to said movable wall plate means (14) for selectively moving said wall plate means (14) in said axial direction of the compressor;

said rotors (7, 8) being coupled with respective journals (11) via their respective bearing shafts (9, 10) solely at the low-pressure end of the compressor;

said movable wall plate means (14) having a sealing surface facing said end surfaces of said casing wall means (2), said sealing surface being imperforate and extending sealingly across said compression chambers;

oil injecting means (22, 23) for injecting oil into said compression chambers (5, 6); and valve means (24) coupled to said oil injection means for throttling or interrupting a flow of oil to said compressor chambers when said movable wall plate means (14) is in its compressor deactivating position;

said valve means (24) being coupled to said movable wall plate means (14), and said valve means (24) being operable to a position for throttling or interrupting said flow of oil to said compression chambers responsive to movement of said movable wall plate means (14) to a position out of sealing abutment with said end surfaces of said casing wall means.

2. The compressor of claim 1, wherein said high-pressure end wall means (4) comprises a cylindr chamber (18) a movable piston (19) mounted on said cylinder chamber (18) and coupled to said movable wall plate means (14), said piston being movable under the influence of pressure fluid.

3. A continuously driven screw compressor adapted for intermittent compressor operation, comprising:

a compressor housing means (1) which comprises a casing wall means (2) which encloses at least two radially overlapping compression chambers (5, 6) each of which accommodates a respective helical rotor (7, 8), said helical rotors each being fixedly connected to a respective bearing shaft (9, 10);

said compressor housing means including a compressor inlet (12);

said housing means (1) having spaced apart end portions, and comprising at respective end portions thereof a high-pressure end wall means (4) at a high pressure end of the compressor, and a low-pressure end wall means (3) at a low pressure end of the compressor;

said casing wall means (2) having end surfaces at least in the vicinity of said high-pressure end wall means (4);

said high-pressure end wall means (4) including;

means defining a space (16) which is in communication with said compressor inlet (12) through a channel (12'); and a movable wall plate means (14) which, in an active compression state of the compressor, is in sealing abutment with said end surfaces of said casing wall means (2) and which, for the purpose of deactivating the compressor, is movable in the axial direction of the compressor in said space (16) in said high-pressure end wall means so as to communicate said compression chambers (5, 6) with said compressor inlet (12) through said space (16) and said channel (12');

auxiliary drive means (20) coupled to said movable wall plate means (14) for selectively moving said wall plate means (14) in said axial direction of the compressor;

oil injecting means (22, 23) for injecting oil into said compression chambers (5, 6); and valve means (24) coupled to said oil injection means for throttling or interrupting a flow of oil to said compressor chambers when said movable wall plate means (14) is in its compressor deactivating position;

said valve means (24) being coupled to said movable wall plate means (14), and said valve means (24) being operable to a position for throttling or interrupting said flow of oil to said compression chambers responsive to movement of said movable wall plate means (14) to a position out of sealing abutment with said end surfaces of said casing wall means.

4. The compressor of claim 3, wherein said high-pressure end wall means (4) comprises a cylinder chamber (18) a movable piston (19) mounted on said cylinder chamber (18) and coupled to said movable wall plate means (14), said piston being movable under the influence of pressure fluid.

* * * * *